US006746213B2

(12) United States Patent
Giacomino

(10) Patent No.: US 6,746,213 B2
(45) Date of Patent: Jun. 8, 2004

(54) PAD PLUNGER ASSEMBLY WITH CONCAVE PAD SUBASSEMBLY

(76) Inventor: Jeff L. Giacomino, 1762 Denver Ave., Ft. Lupton, CO (US) 80621

( * ) Notice: Subject to any disclaimer, the term of this patent is extended or adjusted under 35 U.S.C. 154(b) by 5 days.

(21) Appl. No.: 10/210,930

(22) Filed: Aug. 2, 2002

(65) Prior Publication Data

US 2003/0037920 A1 Feb. 27, 2003

Related U.S. Application Data

(60) Provisional application No. 60/315,300, filed on Aug. 27, 2001.

(51) Int. Cl.[7] ..... F04B 47/12

(52) U.S. Cl. ..... 417/56; 166/153; 277/337; 277/339

(58) Field of Search ..... 417/56–60; 166/153; 277/337, 339

(56) References Cited

U.S. PATENT DOCUMENTS

| | | | | | |
|---|---|---|---|---|---|
| 355,675 | A | | 1/1887 | Baldwin | |
| 1,652,744 | A | | 12/1927 | Sorensen | |
| 2,144,997 | A | | 1/1939 | Thaheld | 309/33 |
| 2,674,956 | A | | 4/1954 | Hilton | 103/225 |
| 3,179,022 | A | | 4/1965 | Bloudoff | 92/252 |
| 3,304,874 | A | * | 2/1967 | Lyles | 417/59 |
| 4,239,458 | A | | 12/1980 | Yeatts | 417/60 |
| 4,528,896 | A | | 7/1985 | Edwards | 92/242 |
| 4,813,485 | A | * | 3/1989 | Coyle | 166/372 |
| 6,145,590 | A | | 11/2000 | Havard | 166/105.2 |
| 6,148,923 | A | | 11/2000 | Casey | 166/372 |
| 6,200,103 | B1 | | 3/2001 | Bender | 417/56 |

* cited by examiner

*Primary Examiner*—Charles G. Freay
(74) *Attorney, Agent, or Firm*—Flanagan & Flanagan; John R. Flanagan

(57) ABSTRACT

A pad plunger assembly, for use in gas well tubing, includes an elongated mandrel having opposite ends and a longitudinal axis extending between the opposite ends, a pair of opposite end members each attached to one of the opposite ends of the mandrel, and a seal-forming pad subassembly disposed about the mandrel and between the opposite end members thereon. The pad subassembly has an outer exterior surface of an annular concave configuration formed by opposite end portions of the outer exterior surface being disposed farther radially outwardly from the longitudinal axis of the mandrel than an intermediate portion of the outer exterior surface is disposed radially outwardly from the longitudinal axis of the mandrel such that a frictional seal which generates reduced friction is provided on the interior wall surface of the gas well tubing.

13 Claims, 1 Drawing Sheet

PAD PLUNGER ASSEMBLY WITH CONCAVE PAD SUBASSEMBLY

This patent application claims the benefit of U.S. provisional application No. 60/315,300, filed Aug. 27, 2001.

BACKGROUND OF THE INVENTION

1. Field of the Invention

The present invention generally relates to a gas lift plunger assembly for use in a gas-producing well and, more particularly, is concerned with pad plunger assembly with a pad subassembly having a concave exterior configuration.

2. Description of the Prior Art

Gas-producing wells typically employ a plunger disposed within tubing of the well and capable of traveling vertically in the tubing as the well is cycled between shut-in and opened conditions in a manner well-known to one of ordinary skill in the art. The plunger is freely movable vertically in the well tubing and is adapted to rise vertically under the force of sufficient gas pressure to drive or lift the plunger and a slug of liquid, such as oil, above it to the surface while isolating the base of the liquid slug from the gas which lifts the plunger. The plunger falls by gravity back down the tubing of the well after the slug of liquid has been delivered to the surface and the gas pressure in the well tubing has decreased due to the transmission of gas from the well tubing to a suitable storage location.

One prior art plunger assembly, being shown in FIG. 1 and called a pad plunger 10, has an elongated rigid non-flexible central rod or mandrel 12 and a pair of end members 14, 16 attached to the opposite ends 12A, 12B of the mandrel 12. Between the opposite ends 12A, 12B of the mandrel 12, the plunger 10 also includes one or more subassemblies 18 of three spring-loaded interlocking pad sections 20 which surround the mandrel 12. The spring-loaded pad subassembly 18 can expand outwardly from and contract inwardly toward the mandrel 12 to compensate for any irregularities in the tubing T. The pad sections 20 of the pad subassembly 18 together form a generally cylindrical exterior surface 22 which creates a moving frictional seal with the interior wall W of the well tubing T.

The conventional view, which it now turns out is a common misconception, is that the longer the pad subassembly of the plunger the more sealing surface provided against the tubing wall and the better the frictional seal formed between the pad plunger and the tubing. Given the cylindrical shape of the exterior surface of the prior art pad subassembly, the more correct view now appears to be the longer the pad subassembly the more friction generated and the less efficiently the plunger runs through the well tubing.

Consequently, a need still exists for an innovation which provides a solution to the aforementioned problem in the prior art without introducing any new problems in place thereof.

SUMMARY OF THE INVENTION

The present invention provides a pad plunger assembly with a pad subassembly having a concave exterior configuration designed to satisfy the aforementioned need. The solution of the present invention to the aforementioned problem is to provide a pad plunger assembly whose pad sections together provide an exterior surface of a concave configuration which minimizes friction on the tubing wall so as to assist the plunger in running more efficiently through the tubing. Such concave configuration solves the aforementioned problem raised by the cylindrical configuration of the prior art pad subassembly.

Accordingly, the present invention is directed to a pad plunger assembly for use in gas well tubing. The pad plunger assembly comprises: (a) an elongated mandrel having opposite ends and a longitudinal axis extending between the opposite ends; (b) a pair of opposite end members each attached to one of the opposite ends of the mandrel; and (c) at least one seal-forming pad subassembly disposed about the mandrel and between the opposite end members thereon, the pad subassembly having an outer exterior surface of an annular concave configuration formed by opposite end portions of the outer exterior surface being disposed farther radially outwardly from the longitudinal axis of the mandrel than an intermediate portion of the outer exterior surface is disposed radially outwardly from the longitudinal axis of the mandrel such that a frictional seal is provided on the interior wall surface of the gas well tubing by the opposite end portions of the outer exterior surface of the pad subassembly which creates less friction than would be created by an outer exterior surface of cylindrical configuration on the pad subassembly.

More particularly, the mandrel is a rigid non-flexible solid rod. The end members and the opposite ends of the mandrel have fastening elements, such as complementary internal and external threads, permitting the end members to be removably fastened, namely threadably attached, to the opposite ends of the mandrel.

Further, a volume is defined between the interior wall surface of the gas well tubing and the intermediate portion of the outer exterior surface of the pad subassembly which traps plunger lifting gas and thereby further enhances the frictional seal between the pad subassembly and the interior wall surface of the gas well tubing.

Still further, the seal-forming pad subassembly includes a plurality of interlocking pad sections disposed about the mandrel and between the opposite end members thereon. The pad sections have coil springs between the pad sections and the mandrel, thereby spring-loading and thus biasing the pad sections to move radially outward from the mandrel such that the pad subassembly can expand outwardly from and contract inwardly toward the mandrel. Each of the pad sections has an outer exterior surface segments of a concave configuration which together form the outer exterior surface of the seal-forming pad subassembly.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 2:
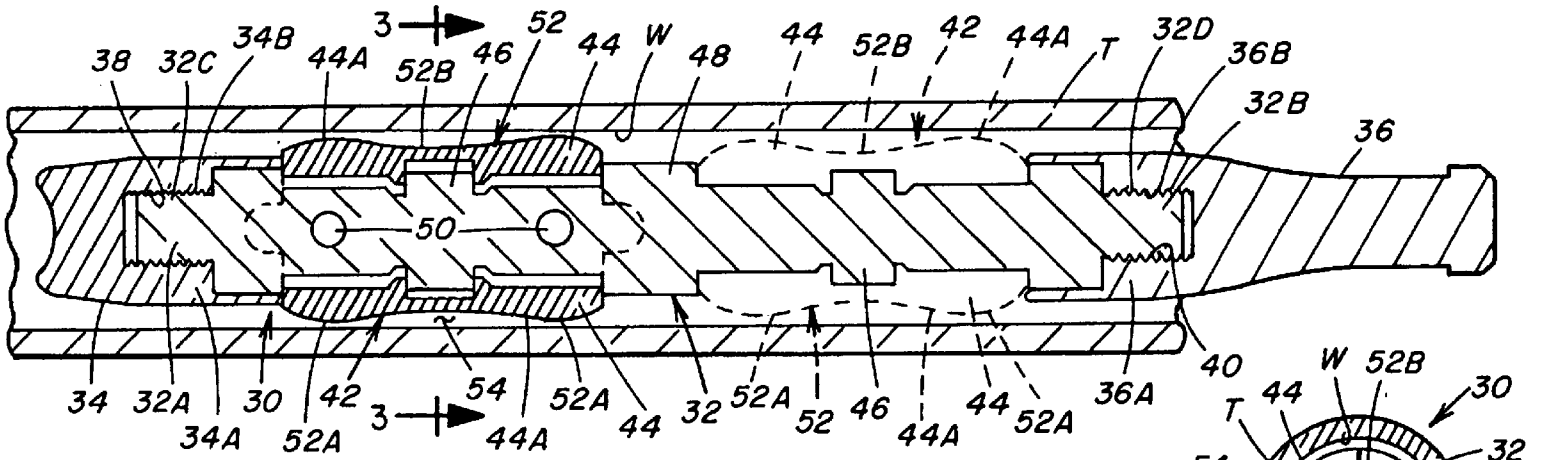
FIG. 2 is a longitudinal sectional view of a pad plunger assembly of the present invention provided with an exterior surface of a generally annular concave configuration.

Referring to the drawings and particularly to FIG. 2, there is illustrated a pad plunger assembly of the present invention, generally designated 30. Basically, the pad plunger assembly 30 includes an elongated central mandrel 32 and a pair of separate end members 34, 36 attached to the opposite ends 32A, 32B of the mandrel 32.

The mandrel 32 of the plunger assembly 30 is in the form of an elongated rigid non-flexible solid rod and has a central longitudinal axis A extending between the opposite ends 32A, 32B of the mandrel 32. The mandrel 32 has the pair of opposite ends 32A, 32B with fastening elements in the form of external threads 32C, 32D formed thereabout. The end members 34, 36 of the plunger 30 have larger diameters than the mandrel 32 and at inner ends 34A, 36A have respective interior bores 38, 40 formed therein with internal threads 34B, 36B defined in the bores 38, 40, permitting threadable removable attachment of the end members 34, 36 to the externally threaded opposite ends 32A, 32B of the mandrel 32.

Between the end members 34, 36 attached at the opposite ends 32A, 32B of the mandrel 32, the plunger assembly 30 also includes one or more pad subassemblies 42 of three interlocking pad sections 44 thereon which also overlie an intermediate annular spacer 46 integrally formed on and extending around the mandrel 32. Each pad subassembly 42 extends between an annular central abutment 48 and one of the end members 34, 36. The pad sections 44 of each of the pad subassemblies 42 are spring-loaded, that is, biased to move radially outward from the mandrel 32 by a plurality of coil springs 50 spaced apart circumferentially from one another about the mandrel 32 and disposed between the mandrel 32 and the pad sections 44 such that each of the pad subassemblies 42 can expand outwardly from and contract inwardly toward the mandrel 32 to compensate for any irregularities in the tubing T as the pad subassembly 42 of the plunger 30 creates a moving frictional seal with the interior wall surface W of the well tubing T.

Figure 3:
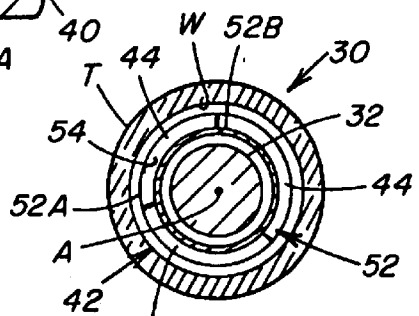
FIG. 3 is a cross-sectional view of the pad plunger assembly taken along line 3—3 of FIG. 2.
Figure 1:
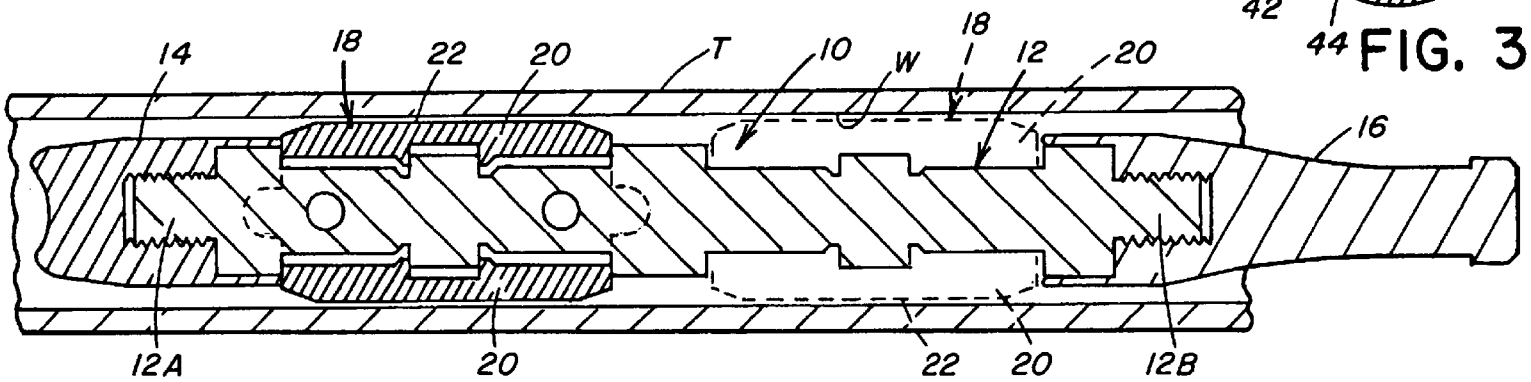
FIG. 1 (PRIOR ART)
FIG. 1 is a longitudinal sectional view of a prior art pad plunger assembly provided with an exterior surface having a generally cylindrical configuration.

In accordance with the present invention, each of the pad sections 44 has an outer exterior surface segment 44A of a concave configuration, and thus each of the pad subassemblies 42 formed by the pad sections 44 has an outer exterior surface 52 of an annular concave configuration such that opposite end portions 52A of the outer exterior surface 52 are disposed closer to the interior wall surface W of the tubing T than the middle or intermediate portion 52B of the exterior surface 52. Thus, since only the smaller area of the opposite end portions 52A of the concave-shaped exterior surface 52 creates the frictional seal with the interior wall surface W of the tubing T, there is less friction created on the tubing interior wall surface W and the plunger 30 thereby runs more efficiently through the tubing T. More particularly, as seen in FIG. 3, the annular concave configuration of the outer exterior surface 52 of each of the pad subassemblies 42 is formed by the opposite end portions 52A thereof being disposed farther radially outwardly from the longitudinal axis A of the mandrel 32 than the intermediate portion 52B of the outer exterior surface 52 is disposed radially outwardly from the longitudinal axis A of the mandrel 32 such that the frictional seal provided on the interior wall surface W of the gas well tubing T by the opposite end portions 52A of the outer exterior surface 52 creates less friction than would be created where the outer exterior surface is of cylindrical configuration as in the case of the prior art pad subassembly. Further, the annular concave shape of the pad subassembly 42 defines a volume 54 between the interior wall surface W of the gas well tubing T and the intermediate portion 52B of the outer exterior surface 52 of the pad subassembly 42 which traps plunger lifting gas and thereby further enhances the frictional seal between the pad subassembly 42 and the interior wall surface W of the gas well tubing T.

The annular concave configuration of the pad subassembly 42 results in minimal contact with the tubing wall W and has enabled an increase in production. In some instance, due to using plungers with concave pad subassemblies, production has been doubled over that when using plungers with conventional cylindrical pad subassemblies.

All of the parts of the pad plunger assembly 30 are made of a suitable metal, such as steel.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A pad plunger assembly for use in gas well tubing, comprising:

(a) an elongated mandrel having opposite ends and a longitudinal axis extending between said opposite ends;

(b) a pair of opposite end members each attached to one of said opposite ends of said mandrel; and (c) at least one seal-forming pad subassembly disposed about said mandrel and between said opposite end members thereon, said pad subassembly having an outer exterior surface of an annular concave configuration formed by opposite end portions of said outer exterior surface being disposed farther radially outwardly from said longitudinal axis of said mandrel than an intermediate portion of said outer exterior surface is disposed radially outwardly from said longitudinal axis of said mandrel such that a frictional seal is provided on the interior wall surface of the gas well tubing by said opposite end portions of said outer exterior surface of said pad subassembly which creates less friction than would be created by an outer exterior surface of cylindrical configuration on said pad subassembly.

2. The assembly of claim 1 wherein a volume is defined between the interior wall surface of the gas well tubing and said intermediate portion of said outer exterior surface of said pad subassembly which traps plunger lifting gas and thereby further enhances the frictional seal between said pad subassembly and the interior wall surface of the gas well tubing.

3. The assembly of claim 1 wherein said mandrel is a rigid non-flexible solid rod.

4. The assembly of claim 1 wherein said end members and said opposite ends of said mandrel have fastening elements permitting said end members to be removably fastened to said opposite ends of said mandrel.

5. The assembly of claim 1 wherein said seal-forming pad subassembly includes a plurality of interlocking pad sections disposed about said mandrel and between said opposite end members thereon.

6. The assembly of claim 5 wherein said pad sections of said seal-forming pad subassembly having coil springs between said pad sections and said mandrel thereby spring-loading and thus biasing said pad sections to move radially outward from said mandrel such that said pad subassembly can expand outwardly from and contract inwardly toward said mandrel.

7. The assembly of claim 5 wherein each of said pad sections has an outer exterior surface segment of a concave configuration which together form said outer exterior surface of said seal-forming pad subassembly.

8. A pad plunger assembly for use in gas well tubing, comprising:

(a) an elongated central mandrel having opposite ends;

(b) a pair of opposite end members attached to said opposite ends of said mandrel; and (c) at least one pad subassembly of a plurality of interlocking pad sections disposed about said mandrel and between said opposite end members thereon, said pad sections being spring-loaded and thus biased to move radially outward from said mandrel by a plurality of coil springs being circumferentially spaced apart from one another about said mandrel and disposed between said mandrel and said pad sections such that said pad subassembly can expand outwardly from and contract inwardly toward said mandrel;

(d) wherein each of said pad sections has an outer exterior surface segment and thus said pad subassembly formed by said pad sections has an outer exterior surface of annular concave configuration formed by said outer exterior surface segments of said pad sections such that only opposite end portions of said outer exterior surface, being disposed in opposite directions from an intermediate portion of said outer exterior surface, provide a frictional seal on the interior wall surface of the gas well tubing which frictional seal creates less friction than would be created by an outer exterior surface of cylindrical configuration on said pad subassembly.

9. The assembly of claim 8 wherein a volume is defined between the interior wall surface of the gas well tubing and said intermediate portion of said outer exterior surface of said pad subassembly which traps plunger lifting gas and thereby further enhances the frictional seal between said pad subassembly and the interior wall surface of the gas well tubing.

10. The assembly of claim 8 wherein said mandrel is a rigid non-flexible solid rod.

11. The assembly of claim 8 wherein said end members and said opposite ends of said mandrel have complementary internal and external threads permitting said end members to be removably threadably attached to said opposite ends of said mandrel.

12. A pad plunger assembly for use in gas well tubing, comprising:

(a) an elongated rigid non-flexible central mandrel having opposite ends;

(b) a pair of opposite end members removably attached to said opposite ends of said mandrel; and (c) a plurality of pad subassemblies each having a plurality interlocking pad sections disposed about said mandrel and between said opposite end members thereon, said pad sections of each pad subassembly being spring-loaded and thus biased to move radially outward from said mandrel by a plurality of coil springs circumferentially spaced apart from one another about said mandrel and disposed between said mandrel and said pad sections such that said pad subassembly can expand outwardly from and contract inwardly toward said mandrel;

(d) wherein each of said pad sections has an outer exterior surface segment and thus each of said pad subassemblies formed by said pad sections has an outer exterior surface of annular concave configuration formed by said outer exterior surface segments of said pad sections such that only opposite end portions of said outer exterior surface of each of said pad subassemblies, being disposed in opposite directions from an intermediate portion of said outer exterior surface, provide a frictional seal on the interior wall surface of the gas well tubing which frictional seal creates less friction than would be created by an outer exterior surface of cylindrical configuration on each of said pad subassemblies.

13. The assembly of claim 12 wherein a volume is defined between the interior wall surface of the gas well tubing and said intermediate portion of said outer exterior surface of said pad subassembly which traps plunger lifting gas and thereby further enhances the frictional seal between said pad subassembly and the interior wall surface of the gas well tubing.

* * * * *